US008561635B2

(12) United States Patent
Pilarczyk et al.

(10) Patent No.: US 8,561,635 B2
(45) Date of Patent: Oct. 22, 2013

(54) HYDRANT SECURITY SYSTEM

(75) Inventors: Eric Pilarczyk, Colorado Springs, CO (US); William T. Ball, Colorado Springs, CO (US); William L. Carlson, Elbert, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 549 days.

(21) Appl. No.: 12/858,971

(22) Filed: Aug. 18, 2010

(65) Prior Publication Data

US 2012/0042959 A1 Feb. 23, 2012

(51) Int. Cl.

| | |
|---|---|
| ***E03B 1/00*** | (2006.01) |
| ***F16K 27/12*** | (2006.01) |
| ***F16K 35/00*** | (2006.01) |

(52) U.S. Cl.

USPC ..... 137/382; 137/383; 70/163; 70/179

(58) Field of Classification Search

USPC ..... 70/163, 176, 232, 179, 231; 137/373, 137/383, 382, 377, 385; 220/210

See application file for complete search history.

(56) References Cited

U.S. PATENT DOCUMENTS

| | | | | |
|---|---|---|---|---|
| 725,290 | A | 4/1903 | Speer | |
| 753,349 | A * | 3/1904 | Bacon | 70/176 |
| 812,021 | A | 2/1906 | Dahl | |
| 961,959 | A | 6/1910 | Herfurth | |
| 1,158,631 | A | 11/1915 | Caldwell | |
| 1,311,115 | A * | 7/1919 | Fischer | 137/382 |
| 3,156,256 | A | 11/1964 | Weaver | |
| 4,300,373 | A | 11/1981 | Camos et al. | |
| 4,316,481 | A * | 2/1982 | Fillman | 137/302 |
| 4,397,332 | A | 8/1983 | Sample | |
| 4,449,694 | A | 5/1984 | Hobart et al. | |
| 4,513,773 | A | 4/1985 | Hardiman, Jr. | |
| 4,781,044 | A | 11/1988 | Ortega | |
| 4,984,698 | A * | 1/1991 | Stuckey | 215/207 |
| 5,074,134 | A * | 12/1991 | Wheadon | 70/175 |
| 5,158,105 | A * | 10/1992 | Conway | 137/296 |
| 5,165,263 | A | 11/1992 | Perron et al. | |
| 5,246,028 | A | 9/1993 | Vandepas | |
| 5,353,833 | A | 10/1994 | Martinez | |
| 5,360,036 | A | 11/1994 | Kieper | |
| D358,455 | S | 5/1995 | Kieper | |
| 5,427,135 | A | 6/1995 | Kieper | |
| 5,515,703 | A * | 5/1996 | Chance | 70/176 |
| 5,590,679 | A | 1/1997 | Almasy et al. | |
| 5,598,724 | A | 2/1997 | Primeau | |
| 5,607,084 | A * | 3/1997 | George | 222/153.03 |
| 5,632,303 | A | 5/1997 | Almasy et al. | |
| 5,649,437 | A | 7/1997 | Royka, Jr. et al. | |
| 5,701,925 | A | 12/1997 | Mulligan et al. | |

(Continued)

OTHER PUBLICATIONS

"Hose Bibb Lock #K-HBL," Keedex, www.keedex.com, accessed May 1, 2009, 1 page.

(Continued)

*Primary Examiner* — John Rivell
*Assistant Examiner* — Kevin Murphy
(74) *Attorney, Agent, or Firm* — Sheridan Ross P.C.

(57) ABSTRACT

A locking system is provided for interconnection to a hydrant. The locking system is generally comprised of a lock body and lock that work in concert to block the operation of hydrant components, namely a control rod and/or a stem screw, that controls fluid flow through the hydrant.

8 Claims, 4 Drawing Sheets

(56) References Cited

U.S. PATENT DOCUMENTS

| | | | | |
|---|---|---|---|---|
| 5,785,074 | A | 7/1998 | Kieper | |
| 5,813,428 | A | 9/1998 | Almasy et al. | |
| 5,904,057 | A * | 5/1999 | Abney et al. | 70/167 |
| 6,135,359 | A | 10/2000 | Almasy et al. | |
| 6,142,172 | A | 11/2000 | Shuler et al. | |
| 6,189,350 | B1 | 2/2001 | Nishimura et al. | |
| 6,205,827 | B1 * | 3/2001 | Lane | 70/180 |
| 6,206,039 | B1 | 3/2001 | Shuler et al. | |
| 6,209,574 | B1 | 4/2001 | Prewitt | |
| 6,354,116 | B1 | 3/2002 | Drake | |
| 6,431,204 | B1 | 8/2002 | Ball | |
| 6,453,707 | B2 | 9/2002 | Nishimura et al. | |
| D470,915 | S | 2/2003 | Ball | |
| 6,532,986 | B1 | 3/2003 | Dickey et al. | |
| D482,431 | S | 11/2003 | Ball | |
| 6,679,473 | B1 | 1/2004 | Ball | |
| 6,769,446 | B1 | 8/2004 | Ball et al. | |
| 6,805,154 | B1 | 10/2004 | Dickey et al. | |
| 6,830,063 | B1 | 12/2004 | Ball | |
| 6,857,442 | B1 | 2/2005 | Ball et al. | |
| 6,883,534 | B2 | 4/2005 | Ball et al. | |
| 6,948,509 | B1 | 9/2005 | Ball, Jr. et al. | |
| 6,948,518 | B1 | 9/2005 | Ball | |
| 7,044,148 | B2 | 5/2006 | Berger et al. | |
| 7,059,337 | B2 | 6/2006 | Ball, Jr. et al. | |
| RE39,235 | E | 8/2006 | Shuler et al. | |
| 7,100,637 | B1 | 9/2006 | Ball | |
| 7,111,875 | B2 | 9/2006 | Ball | |
| 7,234,732 | B2 | 6/2007 | Ball | |
| 7,249,609 | B2 | 7/2007 | Ball | |
| 7,287,404 | B2 | 10/2007 | Nickeas et al. | |
| 7,401,620 | B2 | 7/2008 | Ball | |
| 7,472,718 | B2 | 1/2009 | Ball | |
| 7,543,602 | B2 | 6/2009 | Ball | |
| 7,730,901 | B2 | 6/2010 | Ball | |
| 2003/0024284 | A1 | 2/2003 | Erickson | |
| 2006/0086921 | A1 | 4/2006 | Ball | |
| 2007/0039649 | A1 | 2/2007 | Ball | |
| 2007/0044840 | A1 | 3/2007 | Ball | |
| 2008/0047612 | A1 | 2/2008 | Ball | |
| 2008/0047615 | A1 | 2/2008 | Ball | |
| 2009/0007971 | A1 | 1/2009 | Ball | |
| 2009/0158791 | A1 | 6/2009 | Hudman et al. | |
| 2010/0206392 | A1 | 8/2010 | Ball | |

OTHER PUBLICATIONS

"Secure Backflow Preventers: Sabber-Lok," Technology Update, dw&bp, Apr. 2003, pp. 10-11.

"Full Port Locking Handle Ball Valves," Boshart Industries, Inc., http://www.boshart.com/catalogue/plumbing/valves/ballvalves.pdf, website accessed Feb. 11, 2003, p. 8.

* cited by examiner

HYDRANT SECURITY SYSTEM

FIELD OF THE INVENTION

Embodiments of the present invention are generally related to locks that prevent fluid flow through hydrants or faucets. More specifically, one embodiment of the present invention is a locking system that blocks access to internal componentry of a hydrant that initiates fluid flow through the hydrant.

BACKGROUND OF THE INVENTION

It is often desirable to prevent flow through a hydrant or faucet (hereinafter "hydrant"). More specifically, often thieves will steal water by accessing an outdoor hydrant. Vandals will also turn on a hydrant to create havoc. In one example, pranksters turn on the water of a residence during a cold period where the water will flood the associated yard and freeze. Turning on a hydrant that is interconnected to a hose may also create a situation where ice forms within the hose and hydrant and eventually bursts a water inlet pipe associated with the hydrant.

The afore-mentioned water theft and vandalism has been addressed thus far by providing a lock that is associated with the hydrant outlet. More specifically, as most hydrants include a threaded outlet that receives a hose, i.e. a hose bib, hydrant locks of the prior art interconnect to the outlet to prevent the flow of water from the hydrant. Common hose bib locks are comprised of an internally-threaded cylinder that interconnects to the hose bib threads, which effectively blocks the flow of fluid from the hydrant. The cylinder includes a protrusion having an aperture for receiving a lock that secures an associated cover about the cylinder. The protrusion may be rotatably interconnected to the cylinder such that rotation of the cover will not disconnect the cylinder from the hydrant. If the water is turned on, the cylinder will prevent water from being expelled from the hydrant, thereby rendering the attempt of water theft or vandalism useless. Attention is directed, for example, to U.S. Patent Application Publication No. 2009/0158791 to Hudman, entitled "Tamper-Resistant Hose Bib Lock", U.S. Pat. No. 5,649,437 to Royker, Jr., et al, entitled "Lockable Cover for Threaded Spout", and U.S. Patent Application Publication No. 2006/0130544 to Nickeas et al., entitled "Security Device for a Threaded Element", all which are incorporated by reference herein.

Unfortunately, in cold weather situations, merely blocking the flow of water from the hydrant will not circumvent the vandals. More specifically, some hydrants do not allow the drainage of water from the hydrant subsequent to closure or when a hose is interconnected thereto. In these situations, the bib lock of the prior art would allow the hydrant to fill with fluid that may subsequently freeze and possibly cause damage to the hydrant. In addition, even freezeless hydrants, some of which are listed below, allow for most of the water to drain from the system, but the remaining fluid may remain in the hydrant if prevented from escaping by the bib lock of the prior art.

Thus, it has been a long felt need to provide a system for securing a hydrant that prevents the actuation of components associated with the hydrants that allow fluid to flow therethrough as opposed to merely blocking the outlet of the hydrant. The following disclosure describes an improved hydrant locking mechanism that employs a novel combination of a lock and lock body that selectively is associated with a hydrant to substantially restrict an individual's ability to turn on the hydrant.

SUMMARY OF THE INVENTION

It is one aspect of the present invention to provide a device for preventing the actuation of componentry associated with a hydrant that allows fluid therethrough. More specifically, hydrants are generally comprised of a housing that is positioned on the outside of a structure, such as a dwelling. The housing is also associated with an inlet pipe that supplies fluid thereto and an outlet. The outlet that may be associated with a fluid backflow prevention device or may employ a hose bib for receiving a hose. A control rod is positioned within the inlet pipe that has a first end associated with a plunger that cooperates with an inlet valve that controls the flow of fluid through the hydrant. A second end of the control rod may be associated with a drain valve that allows water to drain from the hydrant in the event that the plunger is positioned within the inlet valve, i.e., a freezeless system. The drain valve of some hydrants is also interconnected to a stem screw that converts rotational motion of an interconnected handle into translational motion of the control rod that selectively inserts and removes the plunger from the inlet valve. The handle is rotatably associated with a packing nut that is interconnected to the housing as well. The handle is usually interconnected to the stem screw by a screw or similar fastening member.

As detailed above, methods of the prior art used to prevent theft or vandalism associated with a hydrant are generally entail blocking the outlet of the hydrant. The drawbacks of this methodology are also outlined above. Thus one aspect of the present invention addresses the drawbacks by alternatively restricting the ability to turn the stem screw and thus pull the plunger from the inlet valve to allow water through the hydrant.

It is another aspect of the present invention to provide a lock that is associated with the housing to prevent fluid flow therethrough. More specifically, one embodiment of the present invention comprises a locking system comprised of a lock that is selectively engaged into a lock body to prevent access to the stem screw. In operation, the handle of the hydrant and the associated packing nut are removed. The packing nut is then replaced by the lock body, which, in one embodiment of the present invention, includes a threaded portion that is that is fastened to the threads of the housing that previously received the packing nut. One skilled in the art will appreciate the other interconnection mechanisms may be employed, such as, for example, a bayonet fitting, or the lock body may be interconnected to the packing nut. The lock body also includes a cavity for receiving a lock. The lock may be a tubular pin tumbler lock having a selectively movable strike or "bolt" that selectively interacts with a recess or aperture in the lock body. One of skill in the art will appreciate that the lock may be of any external shape.

After the lock body is interconnected to the hydrant, the lock is placed within the lock body wherein the bolt is eventually positioned within the recess or aperture thereof to block the stem screw and preventing its rotation. The lock may be actuated by a key, or a combination lock may be employed. Furthermore, a separate lock that is associated with both the locking bolt and the lock cylinder, such as a common master lock or combination lock may be employed. For example, the locks similar to those of the prior art may be used in conjunction with those described herein.

It is another aspect of the present invention to further enhance security of the aforementioned locking system by providing a cover. More specifically, one embodiment of the present invention employs a cover that fits over the locking body, in some instances, completely blocking the same. In one embodiment, the cover is selectively interconnected to the locked cylinder wherein the cover is designed to freely rotate with respect to the lock to prevent rotation of the lock body. In operation, a potential thief or vandal would be unable to disconnect the lock body as the cover would slip relative thereto and not allow sufficient gripping force to turn and remove the locked body from the housing.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
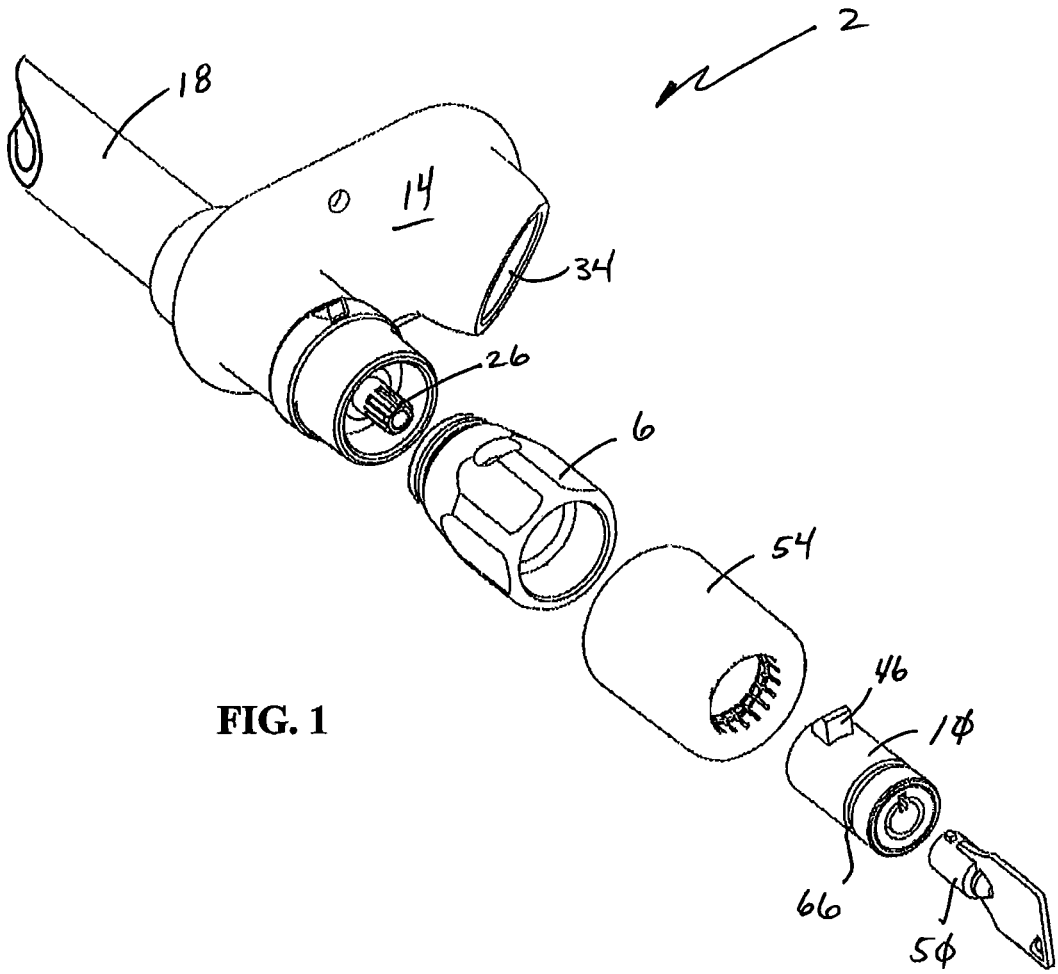
FIG. 1 is an exploded perspective view of one embodiment of the present invention.

To assist in the understanding of one embodiment of the present invention the following list of components and associated numbering found in the drawings is provided herein:

| # | Components |
|---|---|
| 2 | Hydrant |
| 6 | Lock body |
| 10 | Lock |
| 14 | Housing |
| 18 | Inlet pipe |
| 22 | Control rod |
| 26 | Stem screw |
| 30 | Drain valve |
| 34 | Outlet |
| 38 | Drain hole |
| 42 | Cavity |
| 44 | Aperture |
| 46 | Bolt |
| 50 | Key |
| 54 | Cover |
| 58 | Finger |
| 62 | Tip |
| 66 | Groove |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIGS. 1-5, a hydrant 2 is shown associated with a lock body 6 and a lock 10. The hydrant 2 is generally comprised of a housing 14 with an interconnected pipe 18 that supplies fluid to the hydrant 2. A control rod 22 is located within the pipe 18 and is interconnected on one end to an inlet valve and plunger (not shown) and an another end to a stem screw 26 by way of a drain valve 30. In operation, the stem screw 26 is turned by an interconnected handle (not shown), which transitions the drain valve 30 to a closed position and pulls the control rod 22 to unseat the plunger to allow fluid to flow through the hydrant 2 and out an outlet 34. To cease the flow of fluid through the hydrant 2, the stem screw 26 is turned in an opposite direction which moves the plunger into the inlet valve. The closing movement of the stem screw 26 also moves the drain valve 30 such that a drain hole 38 is opened to allow fluid trapped within the pipe 18 to escape from the hydrant 2.

One embodiment of the present invention employs a lock body 6 that is interconnected to a portion of the housing 14 that is generally associated with the stem screw 26. More specifically, the lock body 6 replaces the packing nut that is associated with the handle (not shown). The lock body 6 comprises a cavity 42 that receives the lock 10. The lock body 6 also includes an aperture for receiving a bolt 46 of the lock, which will be described in further detail below. One skilled in the art will appreciate that the aperture 44 may be a recess within the lock body 6 for receiving the bolt 46. One of skill in the art will appreciate that the lock body 6 may be omitted. That is, the housing 14 may include a recess or aperture that would receive the bolt 46. Thus the lock 10 would be directly associated with the hydrant housing 14 to block the stem screw.

The lock 10 of one embodiment of the present invention is a tubular pin tumbler lock, which is generally cylindrical in shape that fits within the cavity 42 of the lock body 6. In operation, the lock is placed within the cavity of the lock body, thereby blocking the stem screw 26. To maintain the lock 10 within the lock body 6, the bolt 46 is provided that fits within the aperture 44 to prevent removal of the lock. The bolt 46 is maintained in position within the aperture 44 by the lock 10, a mechanism that is well known in the art. The lock 10 is actuated by a key 50, which may be a tubular key to fit the aforementioned tubular pin tumbler lock or any other type of key that would selectively lock and release the bolt 46.

To prevent circumvention of the locking system by simply removing the lock body 6, a cover 54 is provided. The cover 54 rotatably interconnects to the lock 10 and is designed to block access to the lock body 6. The cover 54 preferably rotates freely with respect to the lock body 6 and the lock 10, thereby preventing an individual from gripping the lock body 6 to remove it from the housing 14.

Figure 2:
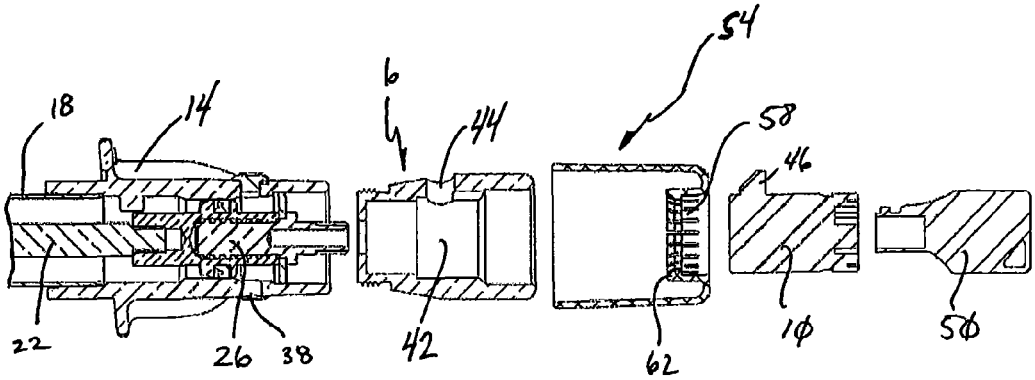
FIG. 2 is a cross-sectional view of FIG. 1.
Figure 3:
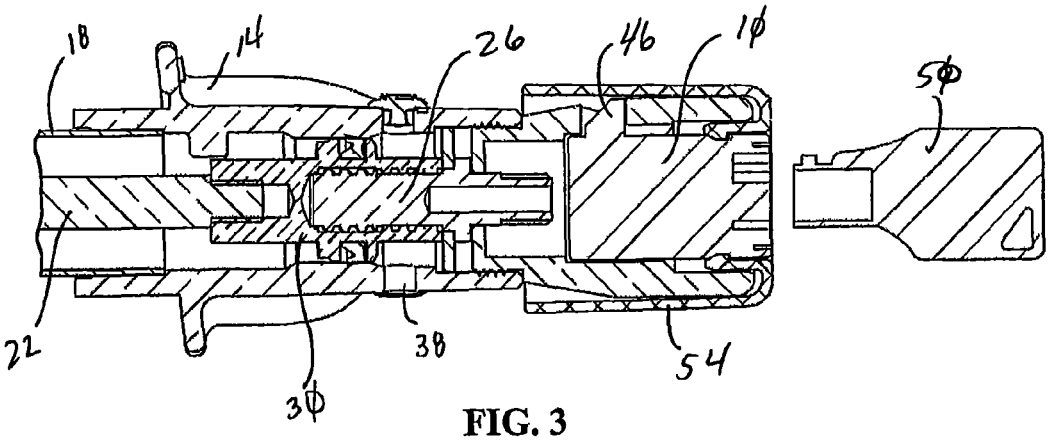
FIG. 3 is a cross-sectional view of FIG. 2 in a non-exploded state.
Figure 4:
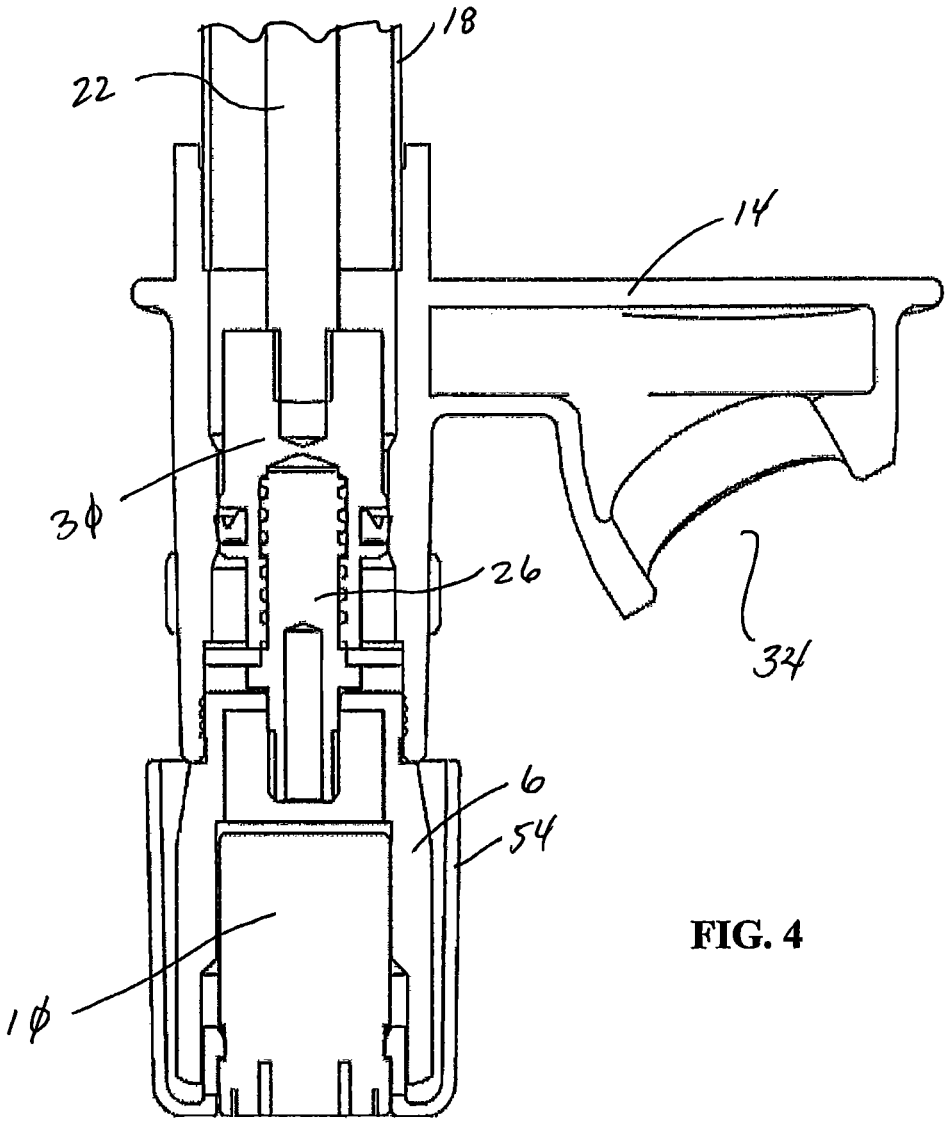
FIG. 4 is a top cross-sectional view of FIG. 3.
Figure 5:
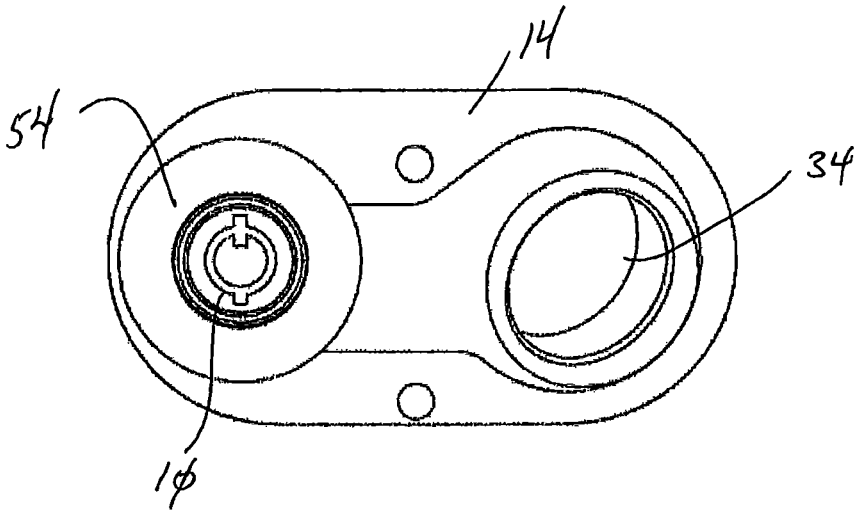
FIG. 5 is a front elevation view of the assembly of one embodiment of the present invention.

With particular reference to FIG. 2, the cover 46 may include a plurality of fingers 58 each which terminate in a tip 62 that fits within a groove 66 of the lock 10. In some embodiments, the tips 62 are tapered in such a way that they help deflect the fingers 58 outwardly to allow them to snap into the groove 66 which interconnects the cover 54 to the lock 10. One skilled in the art will appreciate that a plurality of fingers may be employed or less than that shown. Further, the groove may alternatively be comprised of a series of indentations to receive an individual finger.

The hydrant 2 and associated hardware may be integrated into any faucet assembly. Preferably, the faucet assembly are those manufactured by WCM Industries, Inc., which hold various patents and published patent applications, all of which are incorporated by reference in their entireties herein. For example, the following are incorporated by reference in their entirety herein: U.S. Pat. No. 7,249,609 entitled "Yard hydrant with closure valve check valve", U.S. Pat. No. 7,111, 875 entitled "Wall hydrant with slip clutch assembly", U.S. Pat. No. 7,100,637 entitled "Wall hydrant having backflow preventor", RE39,235 entitled "Freezerless wall hydrant for delivery of hot or cold water through a single discharge conduit", U.S. Pat. No. 7,059,337 entitled "Fluid hydrant", U.S. Pat. No. 6,948,518 entitled "Escutcheon for wall mounted faucets and hydrants", U.S. Pat. No. 6,948,509 entitled "Fluid hydrant", U.S. Pat. No. 6,883,534 entitled "Freeze protection device for wall hydrants/faucets", U.S. Pat. No. 6,857,442 entitled "Freeze protection device for wall hydrants/faucets", U.S. Pat. No. 6,830,063 entitled "Freezeless protection device for wall hydrants/faucets", U.S. Pat. No. 6,805,154 entitled "Freeze protection device for wall hydrants/faucets", U.S. Pat. No. 6,769,446 entitled "Freeze protection device for wall hydrants/faucets", U.S. Pat. No. 6,679,473 entitled "Push and turn hydrant for delivery of hot or cold water through a single discharge conduit", D482,431 entitled "Wall hydrant", U.S. Pat. No. 6,532,986 entitled "Freeze protection device for wall hydrants/faucets", D470,915 entitled "Wall hydrant", U.S. Pat. No. 6,431,204 entitled "Solenoid actuated wall hydrant", U.S. Pat. No. 6,206,039 entitled "Freezeless wall hydrant for delivery of hot or cold water through a single discharge conduit", U.S. Pat. No. 6,142,172 entitled "Freeze protection device for wall hydrants/faucets", U.S. Pat. No. 6,135,359 entitled "Heated yard hydrant", U.S. Pat. No. 5,813,428 entitled "Combination wall hydrant and backflow preventor", U.S. Pat. No. 5,701,925 entitled "Sanitary yard hydrant", U.S. Pat. No. 5,632,303 entitled "Wall water hydrant having backflow and back siphonage preventor", U.S. Pat. No. 5,590,679 entitled "Wall water hydrant having backflow and back siphonage preventor", U.S. Pat. No. 5,246,028 entitled "Sanitary yard hydrant", 2009/0007971 entitled "Faucet Mounting Sleeve" 2008/0047615 entitled "Yard hydrant with check valve", 20080047612 entitled "Automatic draining double check vacuum breaker", 20080006327 entitled "Hydrant Roof Mount", 20070095396 entitled "Assembly to mount a hydrant to a roof", 20070044840 entitled "Motor actuated wall hydrant" 20070044838 entitled "Yard hydrant with closure valve check valve", 20070039649 entitled "Yard hydrant with drain port air line" 20060254647 entitled "Yard hydrant with drain port check valve", 20060196561 entitled "Wall hydrant having a backflow preventor", 20060108804 entitled "Wall hydrant with slip clutch assembly", 20060086921 entitled "Wall hydrant assembly with a rotatable connector", 20050067833 entitled "Pipe coupling for joining pipes of varying diameters", 20050034757 entitled "Freeze protection device for wall hydrants/faucets", and 20040194395 entitled "Round wall-mounted hydrant housing for freezeless wall hydrants and method of installation thereof", and U.S. patent application Ser. No. 12/560,721 entitled "Enclosure for Residential and Commercial Hydrants, and Ser. No. 12/388,324 entitled "Automatic Drawing Freezerless Wall Faucet".

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A hydrant locking device adapted for interconnection to a hydrant body having an inlet that is associated with a fluid pipe, an outlet, and a fluid control portion that includes a threaded portion that surrounds a stem screw and receives a packing nut, comprising:

a lock body having a threaded end adapted to interconnect to the threaded portion of the hydrant body, a cavity and an aperture associating said cavity to an outer surface of said lock body;

a lock having a selectively movable bolt and an outer surface with a groove integrated therein, said lock being fixed within said cavity of said lock body in a predetermined orientation;

a cover comprised of a cylindrical outer surface and a cylindrical inner surface positioned over said outer surface of said lock body wherein said lock body and said lock are concealed with only an outer surface of said lock exposed, said cover also including a portion that extends into an internal volume of said cover that has a plurality of fingers that engage said groove to operably fix said cover to said lock, said cover being freely rotatable about said lock body wherein said lock remains stationary relative to said lock body; and a key that is associated with said lock to selectively move said movable bolt, wherein when said movable bolt is in a first, extended position of use, said lock and said associated cover are interconnected to said lock body, and in a second, retracted position of use, said lock and said associated cover are not interconnected to said lock body wherein said lock and associated cover can be removed from said lock body.

2. The device of claim 1, wherein said plurality of fingers are resiliently deflectable and terminate in a tip that interface with said groove of said lock.

3. The device of claim 1, wherein said lock is a tubular pin tumbler lock.

4. The device of claim 1, wherein said lock restricts access to the stem screw.

5. In combination a fluid hydrant and a locking device therefore, comprising:

a hydrant comprising:

a pipe with a first end and a second end, said pipe having a longitudinal axis, a housing associated with said first end of said pipe, an inlet valve associated with said second end of said pipe, a rod with a first end and a second end positioned within said pipe, a plunger associated said second end of said rod that cooperates with said inlet valve to selectively open and close said inlet valve, wherein rotation of said rod transitions said rod between a first position that closes said inlet valve and a second position that opens said inlet valve, a stem screw, and a drain valve with a first end operably associated with said stem screw and a second end operatively associated with said first end of said rod, wherein rotation of said stem screw moves said drain valve along said longitudinal axis, said drain valve being associated with said rod whereby said rod is moved between said first position and said second position, wherein said drain valve is substantially prevented from rotating, and wherein said stem screw does not move substantially along said longitudinal axis; and a lock, comprising:

a lock body having a threaded end interconnected to the threaded portion of said hydrant housing, a cavity and an aperture associating said cavity to an outer surface of said lock body;

a lock having a selectively movable bolt and an outer surface with a groove integrated therein, said lock being fixed within said cavity of said lock body in a predetermined orientation;

a cover comprised of a cylindrical outer surface and a cylindrical inner surface positioned over said outer surface of said lock body wherein said lock body and said lock are concealed with only an outer surface of said lock exposed, said cover also including a portion that extends into an internal volume of said cover that has a plurality of fingers that engage said groove to operably fix said cover to said lock, said cover being freely rotatable about said lock body wherein said lock remains stationary relative to said lock body; and a key that is associated with said lock to selectively move said movable bolt, wherein when said movable bolt is in a first, extended position of use, said lock and said associated cover are interconnected to said lock body, and in a second, retracted position of use, said lock and said associated cover are not interconnected to said lock body wherein said lock and associated cover can be removed from said lock body.

6. The combination of claim 5, wherein said plurality of fingers are resiliently deflectable and terminate in a tip that interface with said groove of said lock.

7. The combination of claim 5, wherein said lock is a tubular pin tumbler lock.

8. The combination of claim 5, wherein said lock restricts access to the stem screw.

* * * * *